US008878733B2

(12) United States Patent
He et al.

(10) Patent No.: US 8,878,733 B2
(45) Date of Patent: Nov. 4, 2014

(54) ANTENNA HOLDING DEVICE FOR ELECTROMAGNETIC MEASUREMENTS

(75) Inventors: Xiao-Lian He, Shenzhen (CN); Yong-Sheng Yang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 232 days.

(21) Appl. No.: 13/337,128

(22) Filed: Dec. 25, 2011

(65) Prior Publication Data

US 2013/0092813 A1 Apr. 18, 2013

(30) Foreign Application Priority Data

Oct. 13, 2011 (CN) ..... 2011 1 0309708

(51) Int. Cl.
*H01Q 1/12* (2006.01)
*H01Q 3/08* (2006.01)

(52) U.S. Cl.
CPC ..... *H01Q 3/08* (2013.01); *H01Q 1/1228* (2013.01)
USPC ..... 343/703; 343/878; 248/519; 250/338.1

(58) Field of Classification Search
None
See application file for complete search history.

(56) References Cited

U.S. PATENT DOCUMENTS

| | | | | |
|---|---|---|---|---|
| 6,563,301 | B2 * | 5/2003 | Gventer | 324/750.27 |
| 6,888,512 | B1 * | 5/2005 | Daigler | 343/878 |
| 2010/0134364 | A1 * | 6/2010 | Okazaki | 343/703 |

* cited by examiner

*Primary Examiner* — Michael C Wimer
*Assistant Examiner* — Michael Bouizza
(74) *Attorney, Agent, or Firm* — Novak Druce Connolly Bove + Quigg LLP

(57) ABSTRACT

A holding device for holding test antennas includes a base, a sliding plate, a holding pole, and a support block. The sliding plate is slidably mounted on the base. The holding pole is fixed on the sliding plate, and a length of the holding pole is adjustable. The support block is fixed on the holding pole and configured for receiving the test antennas. The holding pole and the sliding plate change a position of the support block along a first axis and a second axis, respectively.

13 Claims, 2 Drawing Sheets

ANTENNA HOLDING DEVICE FOR ELECTROMAGNETIC MEASUREMENTS

BACKGROUND

1. Technical Field

The present disclosure relates to electromagnetic measurements, and particularly to an antenna holding device for electromagnetic measurements.

2. Description of Related Art

In electromagnetic measurements, such as electromagnetic interference (EMI) and site voltage standing-wave ratio (SVSWR) measurements, test antennas need to be respectively mounted on different measuring locations to transmit and/or receive test signals. Mounting the test antennas on and removing the test antennas from the measuring locations may require much work. Furthermore, during the electromagnetic measurements, many parameters (e.g., positions, heights and polarities) of the test antennas often need to be adjusted. The adjustment operations may also require much work, and it is generally difficult to manually adjust these parameters of the test antennas quickly and accurately.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the figures.

DETAILED DESCRIPTION

Figure 1:
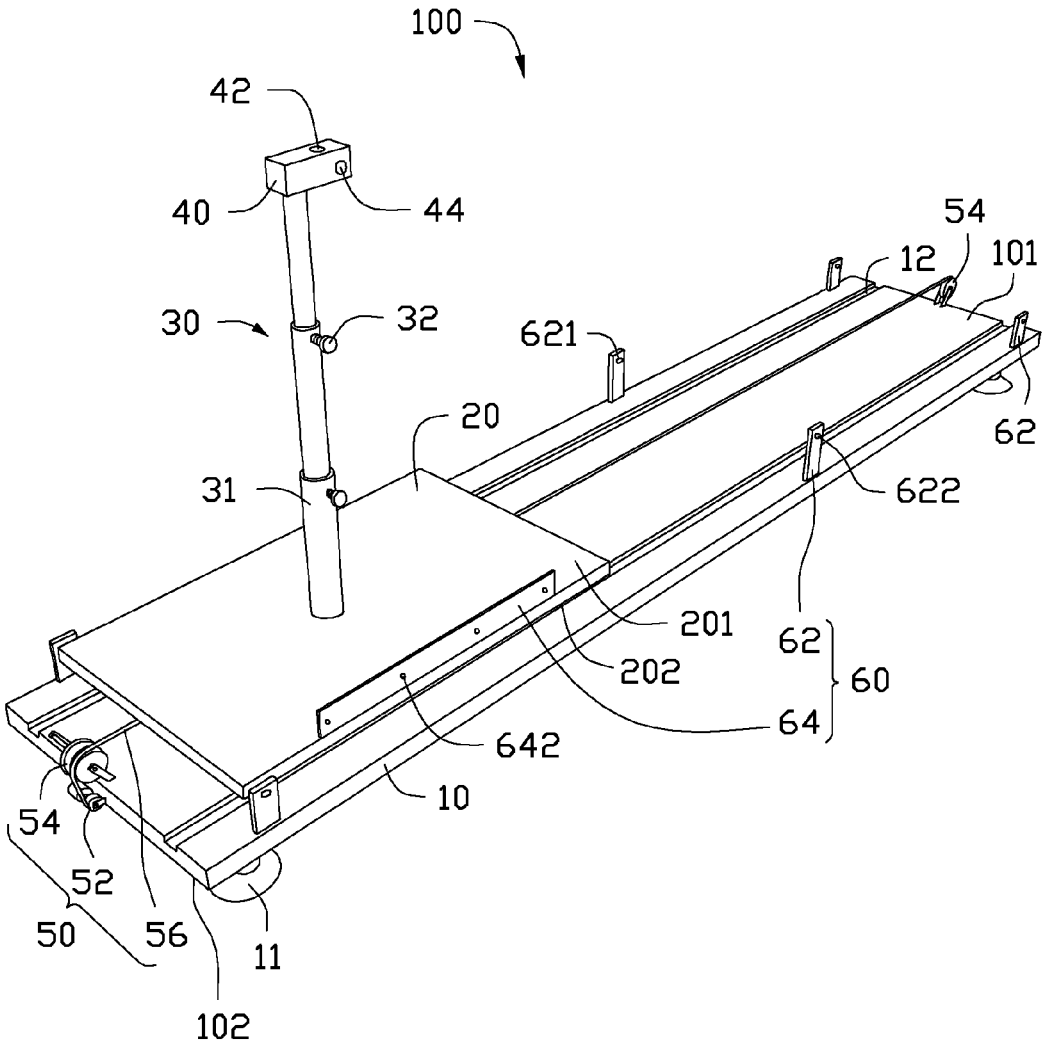
FIG. 1 is a schematic view of an antenna holding device, according to an exemplary embodiment.
Figure 2:
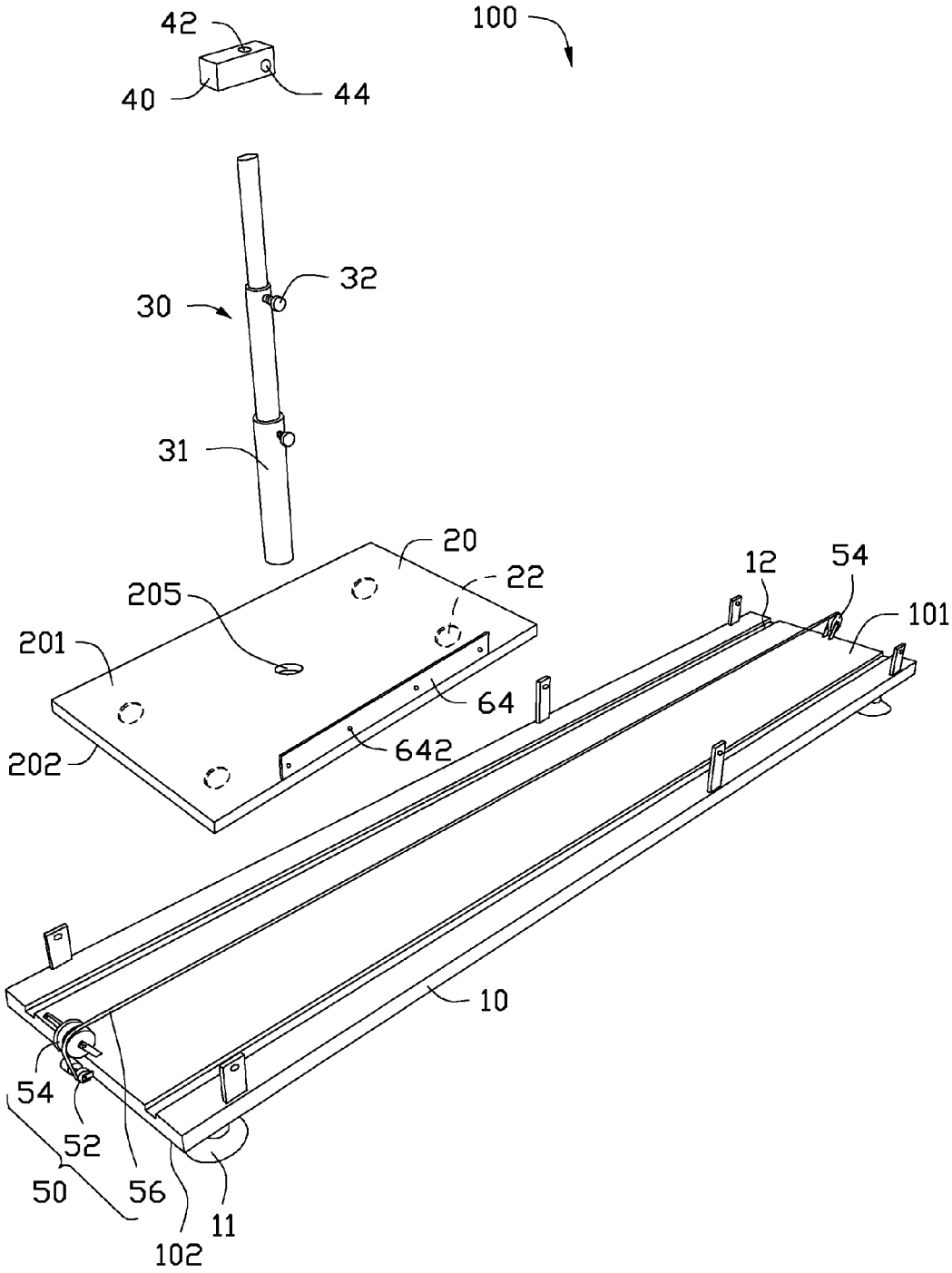
FIG. 2 is an exploded view of the antenna holding device shown in FIG. 1.

FIG. 1 and FIG. 2 show an antenna holding device 100, according to an exemplary embodiment. The antenna holding device 100 can be used to hold test antennas (not shown) that are used for electromagnetic measurements, such as EMI and SVSWR measurements.

The antenna holding device 100 includes a base 10, a sliding plate 20, a holding pole 30, a support block 40, a driving unit 50, and a detection unit 60. The base 10 is substantially a rectangular planar board, and includes a top surface 101 and a bottom surface 102. The top surface 101 and the bottom surface 102 are parallel to each other. Four supporting feet 11 are respectively mounted on four corners of the bottom surface 102, for enabling the antenna holding device 100 to be horizontally positioned. Two parallel linear sliding grooves 12 are defined in the top surface 101. The sliding plate 20, the holding pole 30, the support block 40, the driving unit 50, and the detection unit 60 are all mounted on and/or above the base 10.

The sliding plate 20 is substantially a rectangular planar board, and includes a top surface 201 and a bottom surface 202. Four wheels 22 are rotatably mounted to the sliding plate 20 at the bottom surface 202. Each of the two sliding grooves 12 receives two of the four wheels 22, respectively. Pushing the sliding plate 20 along the sliding grooves 12 can drive the wheels 22 to roll in the sliding grooves 12, and thereby slide the sliding plate 20 along the sliding grooves 12. A holding hole 205 is defined in a center of the top surface 201.

The holding pole 30 includes a number of telescopic sleeves 31. The outermost one of the telescopic sleeves 31 is fixed in the holding hole 205 and thus perpendicularly mounted on the sliding plate 20. Each of the other telescopic sleeves 31 is coaxially received in a proximate outside one of the telescopic sleeves 31 and can be pulled out of the proximate outside telescopic sleeve 31. By pulling a predetermined length of the telescopic sleeves 31 out, a total length of the holding pole 30 can be adjusted. The holding pole 30 further includes a plurality of fasteners 32, such as bolts. The fasteners 32 can be mounted on the telescopic sleeves 31 (e.g., screwed into screw holes defined in the telescopic sleeves 31) to fasten every two corresponding adjacent telescopic sleeves 31 relative to each other.

The support block 40 is substantially a cuboid-shaped (i.e., parallelepiped) block, and is mounted on a distal end of the innermost one of the telescopic sleeves 31. The antenna reception unit 40 defines a first hole 42 at a top and a second hole 44 at a side thereof. The first hole 42 and the second hole 44 are oriented substantially perpendicular to each other. The test antennas may be respectively inserted into the first hole 42 and the second hole 44 to obtain various polarities, such as vertical polarities and horizontal polarities, correspondingly.

The driving unit 50 includes a motor 52, two pulleys 54, and a transmission belt 56. The motor 52 is mounted on the bottom surface 102 of the base 10, and the two pulleys 54 are respectively mounted on two ends of the base 10. The transmission belt 56 is coiled on the motor 52 and the two pulleys 54, and a part of the transmission belt 56 positioned above the top surface 101 of the base 10 is fixed on the bottom surface 202 of the sliding plate 20. The motor 52 can drive the transmission belt 56 to move around the motor 52 and the two pulleys 54, and thus drive the sliding plate 20 to slide along the sliding grooves 12.

The detection unit 60 includes a plurality of static detectors 62 and a movable detector 64. The static detectors 62 are substantially planar sheets perpendicularly mounted on the top surface 101 of the base 10. In particular, the static detectors 62 are all mounted on two long sides of the top surface 101, and are arranged in pairs. Each of the static detectors 62 mounted on one side of the top surface 101 is aligned with one of the static detectors 62 mounted on the other side of the top surface 101, correspondingly. In each pair of the static detectors 62 (i.e., two of the static detectors 62 respectively positioned on two sides of the top surface 101 and aligned with each other), one static detector 62 includes a static infrared emitter 621, and the other static detector 62 includes an infrared sensor 622 aligned with the static infrared emitter 621. The static detectors 62 with the static infrared emitters 621 are all arranged along a far one of the two sides of the top surface 101 (as viewed in FIGS. 1-2), and the static detectors 62 with the infrared sensors 622 are all arranged along a near one of the two sides of the top surface 101 (as viewed in FIGS. 1-2).

The movable detector 64 is a bar-shaped planar sheet mounted on a long side of the top surface 201 of the sliding plate 20, and includes a plurality of movable infrared emitters 642 arranged along a horizontal straight line and equidistantly spaced from each other. When the sliding plate 20 slides along the sliding grooves 12, the movable detector 64 can thus be driven to orderly shield the static infrared emitter 621 of each pair of the static detectors 62 from the infrared sensor 622 of the pair of the static detectors 62, and the movable infrared emitters 642 of the movable detector 64 can be orderly aligned with the infrared sensor 622 of each pair of the static detectors 62.

In use, predetermined lengths of the telescopic sleeves 31 are pulled out to adjust a total length of the holding pole 30 to a predetermined value. The fasteners 32 are mounted on the telescopic sleeves 31 (e.g., screwed into screw holes defined in the telescopic sleeves 31) to fasten corresponding adjacent telescopic sleeves 31 to each other, such that the total length of the holding pole 30 is maintained at the predetermined value. In this way, the support block 40 is positioned at a predetermined height. A common test antenna (not shown) is selectively inserted in the first hole 42 or the second hole 44 to respectively obtain a vertical polarity or a horizontal polarity of the test antenna.

Thus, the antenna holding device 100 having the test antenna positioned therein is positioned in an electromagnetic field in which EMI or SVSWR needs to be tested. The test antenna is electrically connected to a common processor (not shown), such as a personal computer (PC) or a single chip computer. The sliding plate 20 is manually pushed or driven by the motor 52 to slide along the sliding grooves 12, and thus drives the test antenna to be horizontally moved to predetermined test positions. Thus, the processor can transmit and receive wireless signals via the test antenna, and thereby perform electromagnetic measurements.

The static detectors 62 and the movable detector 64 can also be electrically connected to the processor for enabling the processor to detect the position of the sliding plate 20 relative to the base 10. In each pair of the static detectors 62, the static infrared emitter 621 transmits infrared light to the infrared sensor 622, and the infrared sensor 622 generates a first detection signal in response to receiving the infrared light from the static infrared emitter 621 and transmits the first detection signal to the processor. When the static infrared emitter 621 is shielded from the infrared sensor 622 by the movable detector 64 during the movement of the sliding plate 20 or after the sliding plate 20 has stopped moving, the infrared light transmitted from the static infrared emitter 621 is blocked from arriving at the infrared sensor 622. Thus, the infrared sensor 622 is unable to generate the first detection signal, and the processor detects that the sliding plate 20 is positioned between the pair of static detectors 62 in response to not receiving the first detection signal from the infrared sensor 622.

Furthermore, when the test antenna is approximately positioned between any pair of the static detectors 62 and the movable detector 64 shields the static infrared emitter 621 of the pair of the static detectors 62, the movable infrared emitters 642 can be orderly aligned with the infrared sensor 622 of the pair of the static detectors 62 during the movement of the sliding plate 20. Similarly, one of the movable infrared emitters 642 can be aligned with the infrared sensor 622 of the pair of the static detectors 62 after the sliding plate 20 has stopped moving. The infrared sensor 622 generates a second detection signal in response to receiving the infrared light from each of the movable infrared emitters 642, and transmits the second detection signal to the processor. According to the number of times the second detection signals transmitted from the infrared sensor 622 are received by the processor, the processor can detect a moving distance of the sliding plate 20 relative to the pair of the static detectors 62, and thereby further detect the position of the sliding plate 20 more accurately.

The motor 52 can also be electrically connected to the processor. Thus, the processor can control the motor 52 to rotate and thereby horizontally move the test antenna. If the processor detects that the sliding plate 20 is positioned between an outermost pair of the static detectors 62 (i.e., either of the two pairs of the static detectors 62 respectively mounted proximate to two ends of the base 10), and the number of times that the processor receives the second detection signals from the infrared sensor 622 of the outermost pair of the static detectors 62 exceeds a predetermined value, the processor determines that too many movable infrared emitters 642 of the movable sensor 64 have passed the pair of the static detectors 62, and thus determines that an end of the sliding plate 20 has already surpassed the end of the base 10. Accordingly, the processor turns off the motor 52 or controls the motor 52 to reversely rotate, to prevent the sliding plate 20 from sliding out of the sliding grooves 12 and being separated from the base 10.

During use of the antenna holding device 100, the test antenna can be selectively inserted into the first hole 42 or the second hole 44 to respectively obtain various polarities, such as a vertical polarity or a horizontal polarity. The test antenna can also be easily switched between the first hole 42 and the second hole 44 to change the polarity of the test antenna. Furthermore, two test antennas can be respectively inserted into the first hole 42 and the second hole 44 to respectively serve as vertically and horizontally polarized test antennas. As detailed above, the height of the test antenna can be adjusted by means of adjusting the total length of the holding pole 30, and the horizontal position of the test antenna can be adjusted by means of moving the slide unit 20. In other words, the height of the test antenna can be adjusted along a vertical axis, and the horizontal position of the test antenna can be adjusted along a horizontal axis, with the vertical and horizontal axes being perpendicular to each other. Therefore, test antennas held by the antenna holding device 100 can be easily carried between different measuring locations and do not need to be frequently mounted on and removed from these measuring locations. Furthermore, relevant parameters of the test antenna, such as polarity, height, and horizontal position, can be easily adjusted according to the above-described methods.

It is to be further understood that even though numerous characteristics and advantages of the present embodiments have been set forth in the foregoing description, together with details of the structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A holding device for holding a test antenna, comprising:

a base;

a sliding plate slidably mounted on the base;

a holding pole fixed on a top end of the sliding plate, a length of the holding pole being adjustable;

a support block fixed on the holding pole, and configured for receiving the test antenna; and a detection unit comprising a plurality of static detectors and a movable detector, the static detectors mounted on two sides of the base in pairs, each pair of the static detectors located at the two sides of the base, respectively, the movable detector mounted on the sliding plate and driven to move by the sliding plate, and the movable detector shielding one of any pair of the static detectors from the other of the pair of the static detectors when the sliding plate is positioned between the pair of static detectors;

wherein the holding pole and the sliding plate are configured to change a position of the support block along a first axis and a second axis, respectively.

2. The antenna holding device as claimed in claim 1, wherein the support block defines a first hole and a second hole therein, and the first hole and the second hole are configured for receiving test antennas therein and enabling the test antennas received therein to obtain a vertical polarity and a horizontal polarity, respectively.

3. The antenna holding device as claimed in claim 1, wherein both the base and the sliding plate are substantially planar boards; the base defining two sliding grooves, the sliding plate including four rotatable wheels, each of the two sliding grooves respectively receiving two of the four wheels, and the wheels being capable of rolling in the sliding grooves, thereby enabling the sliding plate to slide along the sliding grooves.

4. The antenna holding device as claimed in claim 3, wherein the holding pole is a telescopic rod, and a bottom end of the holding pole is perpendicularly mounted on the sliding plate.

5. The antenna holding device as claimed in claim 3, further comprising a driving unit which drives the sliding plate to slide along the sliding groove.

6. The antenna holding device as claimed in claim 5, wherein the driving unit includes a motor, two pulleys, and a transmission belt; the motor and the two pulleys mounted on the base, the transmission belt coiled on the motor and the two pulleys, and a part of the transmission belt fixed on the sliding plate; and the motor driving the transmission belt to move around the motor and the two pulleys and thereby driving the sliding plate to slide.

7. The antenna holding device as claimed in claim 1, wherein one of each pair of the static detectors includes a static infrared emitter, and the other of the pair of the static detectors includes an infrared sensor aligned with the static infrared emitter for receiving infrared light from the static infrared emitter; and the movable detector prevents the infrared sensor from receiving the infrared light from the static infrared emitter when the infrared sensor is shielded from the static infrared emitter by the movable detector.

8. The antenna holding device as claimed in claim 7, wherein the movable detector includes a plurality of movable infrared emitters, and the movable infrared emitters are capable of being orderly aligned with the infrared sensor of each pair of the static detectors when the sliding plate slides relative to the base.

9. The antenna holding device as claimed in claim 8, wherein when an end of the sliding plate surpasses an end of the base, the infrared sensor mounted proximate to the end of the base receives infrared light from a plurality of the movable infrared emitters a number of times exceeding a predetermined threshold value of times.

10. A holding device for holding a test antenna, comprising:

a base;

a sliding plate slidably mounted on the base;

a holding pole fixed on the sliding plate, a length of the holding pole being adjustable;

a support block fixed on a distal end of the holding pole, and configured for receiving the test antenna; and a detection unit comprising a plurality of static detectors and a movable detector, the static detectors mounted on two sides of the base in pairs, each pair of the static detectors located at the two sides of the base, respectively, the movable detector mounted on the sliding plate and driven to move by the sliding plate, and the movable detector shielding one of any pair of the static detectors from the other of the pair of the static detectors when the sliding plate is positioned between the pair of static detectors;

wherein the holding pole and the sliding plate cooperatively enable the support block to be movable along a first axis and a second axis in order to adjust a position of the test antenna, and wherein the first axis is perpendicular to the second axis.

11. The holding device for holding a test antenna as claimed in claim 10, wherein one of each pair of the static detectors includes a static infrared emitter, and the other of the pair of the static detectors includes an infrared sensor aligned with the static infrared emitter for receiving infrared light from the static infrared emitter; and the movable detector prevents the infrared sensor from receiving the infrared light from the static infrared emitter when the infrared sensor is shielded from the static infrared emitter by the movable detector.

12. The holding device for holding a test antenna as claimed in claim 11, wherein the movable detector includes a plurality of movable infrared emitters, and the movable infrared emitters are capable of being orderly aligned with the infrared sensor of each pair of the static detectors when the sliding plate slides relative to the base.

13. The holding device for holding a test antenna as claimed in claim 12, wherein when an end of the sliding plate surpasses an end of the base, the infrared sensor mounted proximate to the end of the base receives infrared light from a plurality of the movable infrared emitters a number of times exceeding a predetermined threshold value of times.

* * * * *